US010333191B2

(12) United States Patent
Rogozine

(10) Patent No.: US 10,333,191 B2
(45) Date of Patent: Jun. 25, 2019

(54) CERAMIC BLOCK RF FILTER HAVING A FIRST PLURALITY OF THROUGH-HOLE RESONATORS AND A SECOND PLURALITY OF THROUGH-HOLES FOR BLOCKING RF SIGNAL COUPLING

(71) Applicant: CTS Corporation, Lisle, IL (US)

(72) Inventor: Alexandre Rogozine, Rio Rancho, NM (US)

(73) Assignee: CTS Corporation, Lisle, IL (US)

( * ) Notice: Subject to any disclaimer, the term of this patent is extended or adjusted under 35 U.S.C. 154(b) by 0 days.

(21) Appl. No.: 15/711,024

(22) Filed: Sep. 21, 2017

(65) Prior Publication Data

US 2018/0090805 A1 Mar. 29, 2018

Related U.S. Application Data

(60) Provisional application No. 62/399,018, filed on Sep. 23, 2016.

(51) Int. Cl.
*H01P 1/213* (2006.01)
*H01P 1/205* (2006.01)

(52) U.S. Cl.
CPC ..... *H01P 1/2136* (2013.01); *H01P 1/2056* (2013.01)

(58) Field of Classification Search
CPC ..... H01P 1/2056; H01P 7/04; H01P 1/2135; H01P 1/2136
USPC ..... 333/206, 134
See application file for complete search history.

(56) References Cited

U.S. PATENT DOCUMENTS

| | | | |
|---|---|---|---|
| 4,431,977 | A | 2/1984 | Sokola et al. |
| 4,692,726 | A | 9/1987 | Green et al. |
| 5,015,974 | A | 5/1991 | Komazaki et al. |
| 5,103,197 | A | 4/1992 | Turunen et al. |
| 5,319,328 | A | 6/1994 | Turunen et al. |
| 5,379,011 | A | 1/1995 | Sokola et al. |
| 5,495,216 | A | 2/1996 | Jachowski et al. |
| 5,537,082 | A | 7/1996 | Tada et al. |
| 5,675,301 | A | 10/1997 | Naeppae et al. |
| 5,731,746 | A | 3/1998 | Sokola et al. |
| 6,081,174 | A | 6/2000 | Takei et al. |

(Continued)

FOREIGN PATENT DOCUMENTS

| | | | |
|---|---|---|---|
| EP | 2963731 | A1 | 6/2016 |
| WO | 9922417 | A1 | 5/1999 |
| WO | 2004093239 | A1 | 10/2004 |

*Primary Examiner* — Benny T Lee
(74) *Attorney, Agent, or Firm* — Daniel Deneufbourg

(57) ABSTRACT

A ceramic monoblock RF filter for the transmission of an RF signal comprising a block of dielectric material including opposed top and bottom surfaces, opposed longitudinal side surfaces, and opposed transverse side surfaces. A plurality of spaced apart through-hole resonators extend through the block and terminate in openings in the top and bottom surfaces of the block. A second plurality of grounded RF signal blocking through-holes extend through the block and terminate in respective openings in the top and bottom surfaces of the block. The grounded through-holes are located and positioned in a relationship off-set and on opposite sides of the first plurality of through-hole resonators for blocking the coupling of the RF signal between RF signal input/outputs and selected ones of the first plurality of resonators and also between non-adjacent ones of the first plurality of resonators.

13 Claims, 4 Drawing Sheets

(56) References Cited

U.S. PATENT DOCUMENTS

| | | | | |
|---|---|---|---|---|
| 6,650,202 | B2 | 11/2003 | Rogozine et al. | |
| 6,686,817 | B2 | 2/2004 | Zhu et al. | |
| 6,940,364 | B2 * | 9/2005 | Atokawa et al. | H01P 1/2056 333/134 |
| 7,075,388 | B2 | 7/2006 | Rogozine et al. | |
| 7,541,893 | B2 | 6/2009 | Ye | |
| 7,714,680 | B2 | 5/2010 | Vangala et al. | |
| 8,261,714 | B2 | 9/2012 | Nummerdor | |
| 8,294,532 | B2 | 10/2012 | Nummerdor | |
| 9,030,272 | B2 | 5/2015 | Nummerdor | |
| 9,431,690 | B2 | 8/2016 | Rogozine et al. | |
| 9,666,922 | B2 | 5/2017 | Yoshikawa et al. | |
| 2003/0197580 | A1 | 10/2003 | Umeda et al. | |
| 2006/0261913 | A1 * | 11/2006 | Ye | H01P 1/2136 333/134 |
| 2008/0122559 | A1 | 5/2008 | Hoft | |
| 2016/0301122 | A1 | 10/2016 | Chun et al. | |

* cited by examiner

CERAMIC BLOCK RF FILTER HAVING A FIRST PLURALITY OF THROUGH-HOLE RESONATORS AND A SECOND PLURALITY OF THROUGH-HOLES FOR BLOCKING RF SIGNAL COUPLING

CROSS-REFERENCE TO RELATED APPLICATION

This patent application claims priority and benefit of the filing date of U.S. Provisional Patent Application Ser. No. 62/399,018 filed on Sep. 23, 2016, the disclosure and contents of which are expressly incorporated herein in its entirety by reference.

TECHNICAL FIELD

This invention relates to a radio-frequency (RF) filter and, more specifically, to a ceramic monoblock RF filter with grounded through-holes in the filter block unwanted RF signal coupling and provide additional RF signal rejection outside of the bandwidth of the RF filter without an increase in the length or size of the filter.

BACKGROUND OF THE INVENTION

Ceramic monoblock radio-frequency (RF) filters provide for the attenuation/rejection of RF signals with frequencies outside of a particular frequency range or band and little rejection/attenuation to RF signals with frequencies within a particular range or band of interest.

These filters most typically take the form of a six sided block of ceramic material having a plurality of resonators/poles in the form of through-holes extending through the interior of the block and terminating in openings in the opposed top and bottom surfaces or sides of the block such as, for example, as shown in U.S. Pat. No. 4,431,977 to Sokola et al. and U.S. Pat. No. 4,692,726 to Green et al, the disclosures and descriptions of which are incorporated herein by reference.

The bandpass of such a ceramic monoblock filter can be designed for specific bandpass requirements. Typically, the tighter or narrower the bandpass, the higher the insertion loss becomes, i.e., an important electrical parameter. A wider bandwidth, however, reduces the filter's capacity to attenuate/reject unwanted frequencies, i.e., frequencies which are known in the art as rejection frequencies.

Moreover, the reactive RF signal coupling between adjacent and non-adjacent resonators, and thus the level of rejection outside of a bandwidth and performance of such filters is dictated at least to some extent by the physical dimensions of each resonator, by the orientation and location of the resonators relative to each other, and by aspects of the top metallization pattern that is applied to the top surface or side of the block of the filter. Interactions of the electric and electromagnetic fields within and around the resonators and the block are complex and difficult to predict.

Currently, increased levels of rejection of the RF signal outside of a filter's bandwidth and thus improved filter performance can be achieved by adding resonators to the ends of the block. Increasing the length or size of the block however is not desirable in applications where space is limited on, for example, a customer's motherboard.

The present invention is directed to a ceramic monoblock RF filter providing increased levels of rejection outside of a filter's bandwidth and increased performance through the use of structure which in one embodiment comprises grounded RF signal blocking through-holes located and positioned in the filter in a manner that blocks unwanted RF signal coupling between resonators but does not require an increase in the length or size of the RF filter.

SUMMARY OF THE INVENTION

The present invention relates generally to an RF filter for the transmission of an RF signal comprising a block of dielectric material including opposed top and bottom surfaces, opposed longitudinal side surfaces, and opposed transverse side surfaces, at least first and second RF signal input/outputs defined on the block of dielectric material, a first plurality of resonators defined on the block of dielectric material, and means on the block of dielectric material for blocking the coupling of the RF signal between the first and/or second RF signal input/outputs and respective ones of the first plurality of resonators or between respective non-adjacent ones of the first plurality of resonators.

In one embodiment, the first plurality of resonators comprise a first plurality of through-hole resonators extending through the block of dielectric material and terminating in respective openings in the top and bottom surfaces of the block of dielectric material, the means for blocking the coupling of the RF signal comprising one or more grounded RF signal blocking through-holes extending through the block of dielectric material and terminating in respective openings in the top and bottom surfaces of the block of dielectric material and located in a relationship spaced and off-set from one or more of the first plurality of through-hole resonators.

In one embodiment, the one or more RF signal blocking through-holes are located between and spaced from the first plurality of through-hole resonators and the respective opposed longitudinal side surfaces.

In one embodiment, a plurality of RF signal blocking through-holes are located on opposed sides of and spaced from the first plurality of through-hole resonators.

The present invention is also directed to an RF filter for the transmission of an RF signal comprising a block of dielectric material including opposed top and bottom surfaces, opposed longitudinal side surfaces, and opposed transverse side surfaces, a first plurality of through-holes extending through the block and terminating in respective openings in the top and bottom surfaces of the block and defining a first plurality of through-hole resonators, and a second plurality of through-holes extending through the block and terminating in respective openings in the top and bottom surfaces of the block, the second plurality of through-holes being located and positioned relative to the first plurality of through-holes for blocking the coupling of the RF signal between selected ones of the first plurality of through-hole resonators.

In one embodiment, the second plurality of through-holes are positioned on the block of dielectric material in a relationship spaced and off-set from the first plurality of through-holes.

In one embodiment, the openings of the respective first and second plurality of through-holes defined in the top and bottom surfaces of the block of dielectric material are surrounded by pads of metallization and a layer of metallization respectively and the interior surface of the respective first and second plurality of through-holes are covered with a layer of metallization to define the first plurality of through-hole resonators and the second plurality of through-holes defining a second plurality of grounded through-holes.

The present invention is further directed to an RF filter for the transmission of an RF signal comprising a block of dielectric material including opposed top and bottom surfaces, opposed longitudinal side surfaces, and opposed transverse side surfaces, first, second, and third RF signal input/outputs defined on the block of dielectric material, a first plurality of through-holes extending through the block and terminating in respective openings in the top and bottom surfaces of the block and defining a first plurality of through-hole resonators, and a second plurality of grounded through-holes extending through the block and terminating in respective openings in the top and bottom surfaces of the block, the second plurality of through-holes being located and positioned on opposite sides of and spaced from the first plurality of through-holes and further in a relationship off-set from the first plurality of through-holes for blocking the coupling of the RF signal between non-adjacent ones of the first plurality of through-hole resonators and between the first, second, and/or third RF signal input/outputs and selected ones of the first plurality of through-hole resonators.

In one embodiment, a first one of the second plurality of grounded through-holes is positioned adjacent the first RF signal input/output and between first and second ones of the first plurality of through-hole resonators for blocking the coupling of the RF signal between the first RF signal input/output and the first one and a third one of first plurality of through-hole resonators.

In one embodiment, a second one of the second plurality of grounded through-holes is positioned between the third one and a fourth one of the first plurality of through-hole resonators for blocking the coupling of the RF signal between the second one and a fourth one of the first plurality of through-hole resonators.

In one embodiment, a third one of the second plurality of grounded through-holes is positioned adjacent to the second RF signal input/output and between the fifth and a sixth one of the first plurality of through-hole resonators for blocking the coupling of the RF signal between the fifth one of the first plurality of through-hole resonators and the second RF signal input/output.

In one embodiment, a fourth one of the second plurality of grounded through-holes is positioned between the third and fourth ones of the first plurality of through-holes resonators for blocking the coupling of the RF signal between the third one and the fifth one of the first plurality of through-hole resonators.

In one embodiment, a fifth one of the second plurality of grounded through-holes is positioned between the sixth one and a seventh one of the first plurality of through-hole resonators for blocking the coupling of the RF signal between the sixth one and the seventh one of the first plurality of through-hole resonators.

In one embodiment, a sixth one of the second plurality of grounded through-holes is positioned adjacent the second RF signal input/output for blocking the coupling of the RF signal between the seventh one and an eight one of the first plurality of through-hole resonators.

In one embodiment, a seventh one of the second plurality of grounded through-holes is positioned adjacent the third RF signal input/output and between eleventh and twelfth ones of the first plurality of through-hole resonators for blocking the coupling of the RF signal between the third RF signal input/output and the eleventh one of the first plurality of through-hole resonators.

There are other advantages and features of this invention, which will be more readily apparent from the following detailed description of the embodiment of the invention, the drawings, and the appended claims.

BRIEF DESCRIPTION OF THE FIGURES

In the accompanying drawings that form part of the specification, and in which like numerals are employed to designate like parts throughout the same.

DETAILED DESCRIPTION OF THE EMBODIMENT

Figure 1:
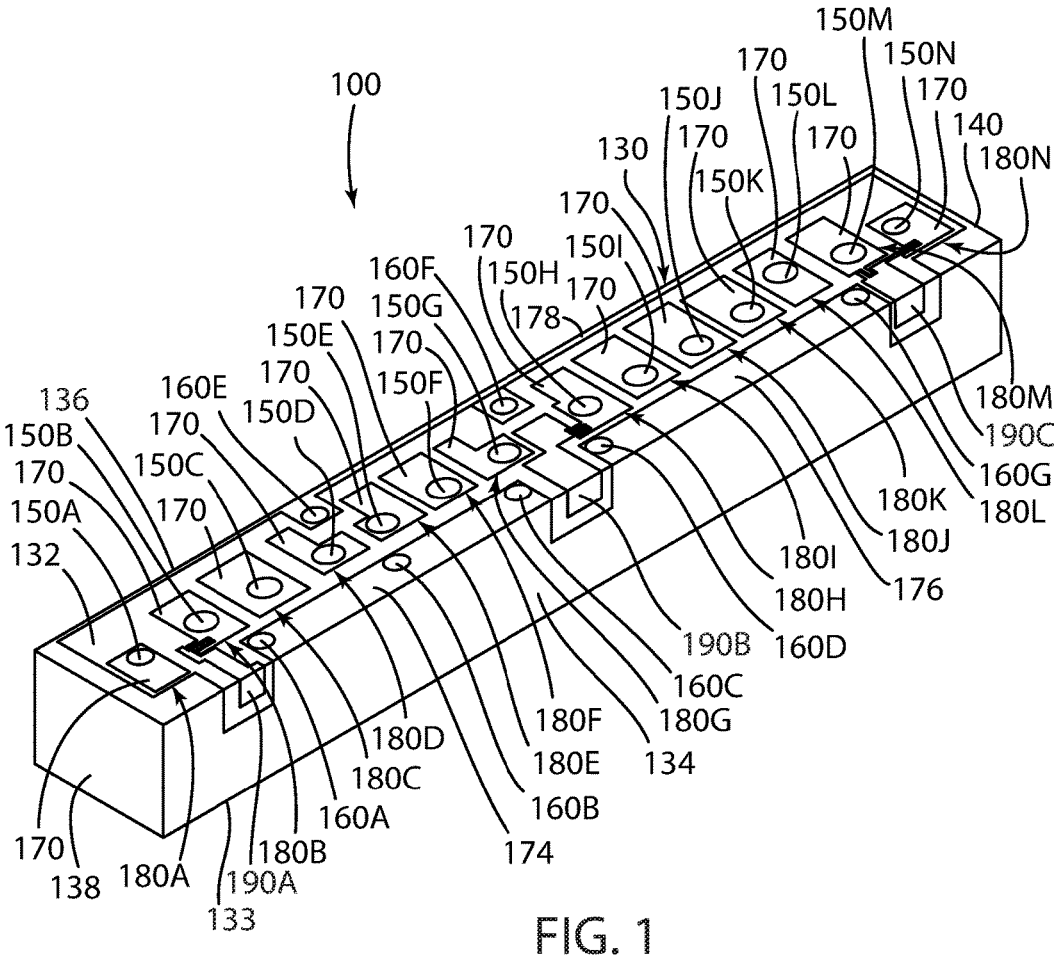
FIG. 1 is a perspective view of a ceramic monoblock filter in accordance with the present invention.
Figure 2:
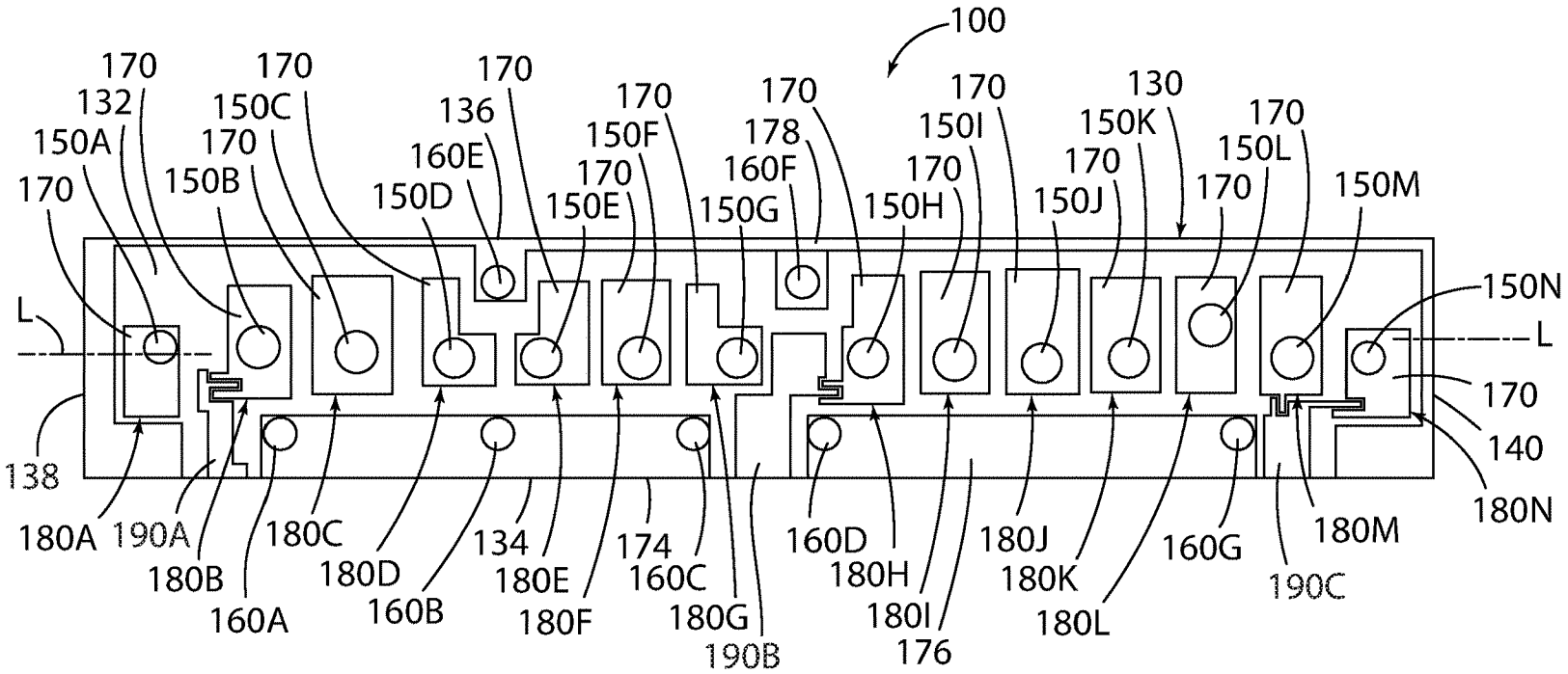
FIG. 2 is a plan view of the top surface of the ceramic monoblock RF filter shown in FIG. 1.
Figure 3:
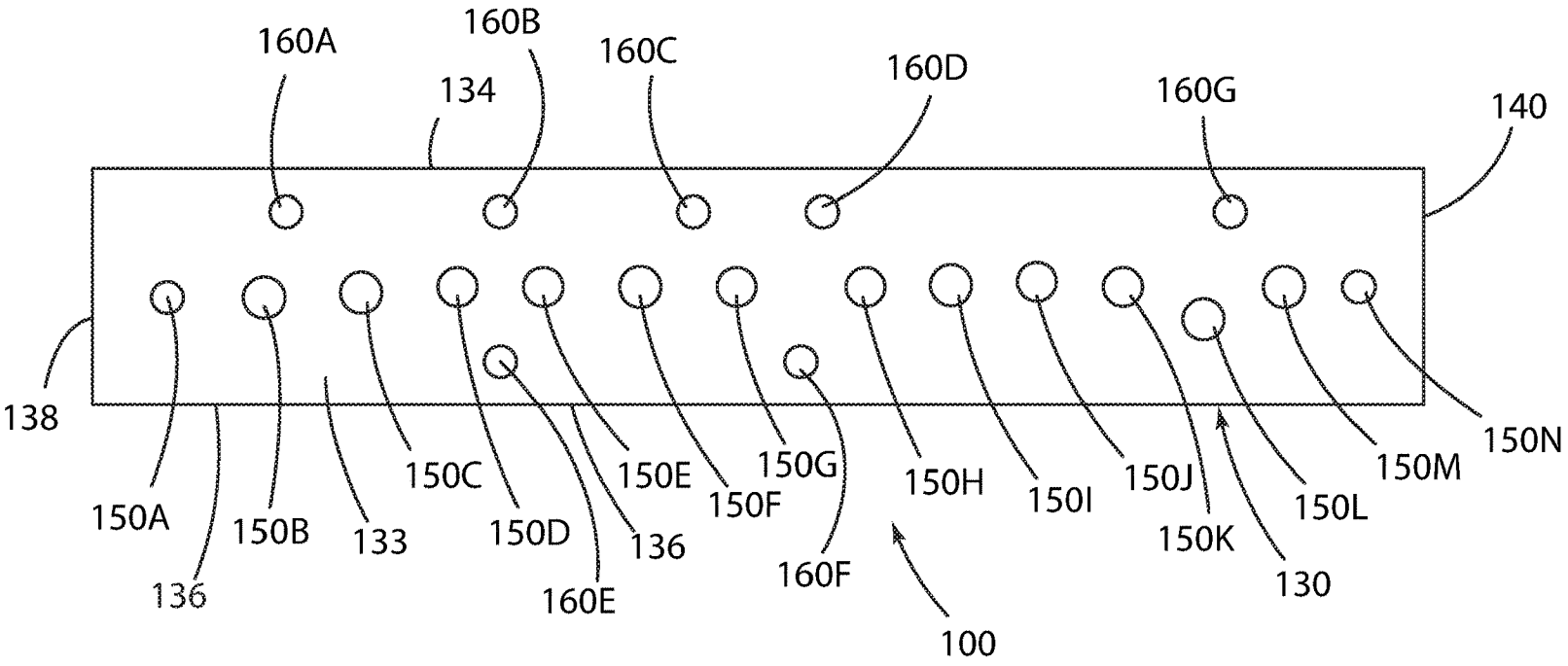
FIG. 3 is a plan view of the bottom surface of the ceramic monoblock RF filter shown in FIG. 1.

FIGS. 1, 2, and 3 depict a ceramic monoblock radio-frequency (RF) filter 100, and more specifically a duplexer RF filter, in accordance with the present invention that includes an elongate, parallelepiped (or "box shaped") solid core or body or monoblock 130 composed of ceramic dielectric material and including three sets of opposing side surfaces: a top longitudinal surface 132 (FIGS. 1 and 2), a bottom longitudinal surface 133 (FIGS. 1 and 3) opposed, spaced, and parallel to the top surface 132; opposing, spaced apart, and parallel long or longitudinally extending sides or surfaces 134 and 136; and opposed short or transversely extending sides or surfaces 138 and 140. The interface between the sides 134, 136, 138, and 140 define four vertical, parallel, and spaced apart edges extending between the top surface 132 and the bottom surface 133. The core 130 has a length, a width, and a height.

The core 130 defines a first plurality of generally cylindrically shaped and generally centrally located through-hole passageways or through-holes 150A, 150B, 150C, 150D, 150E, 150F, 150G, 150H, 150I, 150J, 150K, 150L, 150M and 150N which extend between, and terminating in, openings in the top surface 132 and openings in the bottom surface 133. In the embodiment shown, the through-hole passageways 150A-150N are generally centrally located on the core 130; extend along and in the same direction as the longitudinal central axis L (FIG. 2) of the core 130 in a spaced apart relationship between the transverse sides 138 and 140; and are spaced from and generally parallel to and located between the opposed longitudinal sides 134 and 136.

In accordance with the present invention, the core 130 additionally defines a second plurality of generally cylindrically shaped through-hole passageways or through-holes 160A, 160B, 160C, 160D, 160E, 160F and 160G also extending between, and terminating in, openings in the top surface 132 and openings in the bottom surface 133 respectively.

In the embodiment shown, the through-hole passageways 160A, 160B, 160C, 160D, and 160G extend in a spaced apart and generally co-linear relationship in the same direction as the core longitudinal axis L and more specifically extend along and spaced from and adjacent to the longitudinal side 134 and still more specifically extend between and spaced from and generally parallel to the central longitudinal axis L and the longitudinal side 134 and, yet still more specifically, between and spaced from the through-hole passageways 150A-150N and the longitudinal side 134.

Further, in the embodiment shown, the through-hole passageways 160E and 160F extend in a spaced apart and generally co-linear relationship in the same direction as the core longitudinal axis L and more specifically extend along and spaced from and adjacent to and spaced from the opposed longitudinal side 136 and still more specifically extend between and spaced from and generally parallel to the central longitudinal axis L and the longitudinal side 136 and yet still more specifically, between and spaced from the through-hole passageways 150A-150N and the longitudinal side 136.

Thus, in the embodiment shown, the plurality of through-hole passageways 160A, 160B, 160C, 160D, and 160G and the plurality of through-hole passageways 160E and 160F are respectively located on opposite sides of and spaced from and generally parallel to and offset from the core central longitudinal axis L and further in a relationship spaced from and on opposite sides of and offset from and parallel to the plurality of central trough-hole passageways 150A-150N.

Still further, in the embodiment shown in FIGS. 1 and 2, the through-hole passageway 160A is positioned adjacent and to the right of the RF signal input/output port 190A, between RF signal input/output ports 190A and 190B, and further is located and positioned in the longitudinal direction and orientation between and off-set from the through-hole passageways 150B and 150C; the through-hole passageway 160B is located and positioned between the RF signal input/output ports 190A and 1906 and further is located and positioned in the longitudinal direction and orientation between and offset from the through-hole passageways 150D and 150E; the through-hole passageway 160C is located and positioned adjacent and to the left of the RF signal input/output port 1906, between and spaced from the RF signal input/output ports 190A and 1906, and further is located and positioned in the longitudinal direction and orientation between and off-set from the through-hole passageways 150F and 150G; and the through-hole passageway 160D is located and positioned adjacent and to the right of the RF signal input/output port 1906, between and spaced from the input/output ports 190*b* and 190C, and further is located and positioned in the longitudinal direction and orientation between and off-set from the through-hole passageways 150G and 150H.

Moreover, the through-hole passageway 160E is positioned and located between and spaced from the RF signal input/output ports 190A and 1906 and further is located and positioned in the longitudinal direction and orientation between and off-set from the through-hole passageways 150D and 150E; the through-hole passageway 160F is positioned and located opposite and spaced from the input/output port 1906 and further is located and positioned in the longitudinal direction and orientation between and spaced from the through-hole passageways 150G and 150H; and the through-hole passageway 160G is locates adjacent and to the left of the input/output port 190C, between and spaced from the RF signal input/output ports 190B and 190C, and further is located and positioned in the longitudinal direction and orientation between and off-set from the through-hole passageways 150L and 150M.

The core 130 is rigid and is preferably made of a ceramic material selected for mechanical strength, dielectric properties, plating compatibility, and cost.

The filter 100 includes a pattern of metallized and unmetallized areas or regions and, more specifically, an expansive area or region of metallization on the top surface 132 that defines the respective input/output ports or pads 190A, 1906 and 190C and includes respective portions extending from the top surface 132 onto the side surface 134. The pattern on the top surface 132 additionally defines respective pads or regions of metallization 170 surrounding each of the plurality of through-hole passageways 150A-150N and further respective additional strips or regions of metallization 174 and 176 extending along the side 134 and into the expansive area or region of metallization 162 covering the side 134 and also a strip or region of metallization 178 extending along the opposed side 136 and into the expansive area or region of metallization 162 covering the side 136.

In the embodiment shown in FIGS. 1 and 2, the through-hole passageways 160A, 160B, and 160C are located in the metallized region 174; the through-hole passageways 160E and 160F are located in the metallized region 176; and the through-hole passageways 160D and 160G are located in the metallized region 178.

Thus, the expansive metallized area covers portions of the top surface 132 and side surface 134 and substantially all of the side surfaces 136, 138, and 140 and the bottom surface 133 in FIGS. 1 and 3 and the interior sidewalls or surfaces of the plurality of through-hole passageways 150A-150M and 160A-160G. The expansive metallized area extends contiguously from within the interior surface of the plurality of through-hole passageways 150A-150M and 160A-160G towards both the top surface 132 and bottom surface 133 to define and serve as local electrical ground.

In particular, the metallized area extending contiguously from within the interior surface of the plurality of through-hole passageways 160A-160G towards and in contiguous electrical coupling relationship with the respective metallization areas 174, 176, and 178 (FIG. 1) in the top surface 132 that surround the top openings of the respective through-hole passageways 160A-160G and the metallization on the bottom surface 133 that surrounds the bottom openings of the respective through-hole passageways 160A-160G define and form respective electrically grounded or ground through-hole passageways 160A-160G.

The core 130, the pattern of metallized and unmetallized regions or areas including the respective regions or pads of metallization on the top surface 132, and the plurality of through-hole passageways 150A-150M together form and define a series of through-hole resonators 180A, 180B, 180C, 180D, 180E, 180F, 180G, 180H, 180I, 180J, 180K, 180L, 180M and 180N for the transmission of an RF signal through the duplexer RF filter 100 including, for example, the transmission of a transmit RF signal that is inputted through the RF signal input/output port 190A, travels and is filtered through respective through-hole resonators 180A-180G and is outputted through the antenna RF signal input/output port 1906 and an RF signal that is received through the antenna RF signal input/output port 1906, travels and is filtered through respective through-hole resonators 180M-180H and is outputted through the RF signal input/output port 190C.

Thus, in the embodiment shown, the through-hole resonator 180A is located on the block 130 between the transverse side surface 138 and the first RF signal input/output pad 190A; the through-hole resonators 180B-180G and the grounded through-holes 160A, 160B, 160C, and 160E are located on the block 130 between the first end RF signal input/output pad 190*a* and the second center RF signal antenna input/output pad 190B; the grounded through-hole 160F is located on the block 130 opposite the RF signal antenna input/output pad 190B; the through-hole resonators 180H-180L and the grounded through-hole 160G are located between the second RF signal antenna input/output pad 1906 and the third end RF signal input/output pad 190C; the through-hole resonator 180M is located on the block 130 opposite the third end RF signal input/output pad 190C; and the through-hole resonator 180N is located on the block 30 between the third end RF signal input/output pad 190*c* and the transverse side surface 140 of the block 30.

In accordance with the present invention, the addition of the grounded through-hole passageways 160A-160G advantageously creates additional electrical capacitors and define means or structures on the block 130 and the filter 100 that block unwanted electric coupling between the input/output ports 190A, 1906, and 190C and selected ones of the through-hole resonators 180A-180N and also unwanted electromagnetic couplings between non-adjacent selected ones of the plurality of through-hole resonators 180A-180N which in turn provides and allows for an added or increased levels of rejection of the RF signal outside of the high and low bandpass of the filter 100 which in turn provides and allows for increased filter performance without adding resonators to the ends of the filter 100 and increasing the length or size of the filter 100.

More specifically, in the embodiment shown in FIGS. 1 and 2, the grounded through-hole passageway 160A blocks the direct electrical coupling and transmission of the RF signal between the RF signal input/output port 190A and the through-hole resonator 180C and also block the direct electromagnetic coupling and transmission of the RF signal between non-adjacent through-hole resonators 180B and 180D (i.e., the through-hole passageway 160A prevents the RF signal from bypassing the adjacent through-hole resonator 180C); the grounded through-hole passageway 160B blocks the direct electromagnetic coupling and transmission of the RF signal between non-adjacent through-hole resonators 180C and 180E (i.e., the grounded through-hole passageway 160B prevents the RF signal from bypassing the adjacent through-hole resonator 180D); the grounded through-hole passageway 160E blocks the direct electromagnetic coupling and transmission of the RF signal between non-adjacent through-hole resonators 180D and 180F (i.e., the grounded through-hole passageway 160E prevents the RF signal from bypassing the adjacent through-hole resonator 180E); and the grounded trough-hole passageway 160C blocks the direct electrical coupling and transmission of the RF signal between the through-hole resonator 180F and the RF signal antenna input/output port 190B (i.e., the through-hole passageway 160C prevents the RF signal from bypassing the adjacent through-hole resonator 180G).

Moreover, the grounded through-hole passageway 160D blocks the direct electrical coupling and transmission of the RF signal between the RF signal input/output port 190B and the through-hole resonator 180I (i.e., the through-hole passageway 160D prevents the RF signal from bypassing the through-hole resonator 180H); and the grounded through-hole passageway 160G blocks the direct and electrical coupling and transmission of the RF signal between the through-hole resonator 180L and the RF signal input/output port 190C (i.e., the through-hole passageway 160G prevents the RF signal from bypassing the adjacent resonator 180M).

Figure 4:
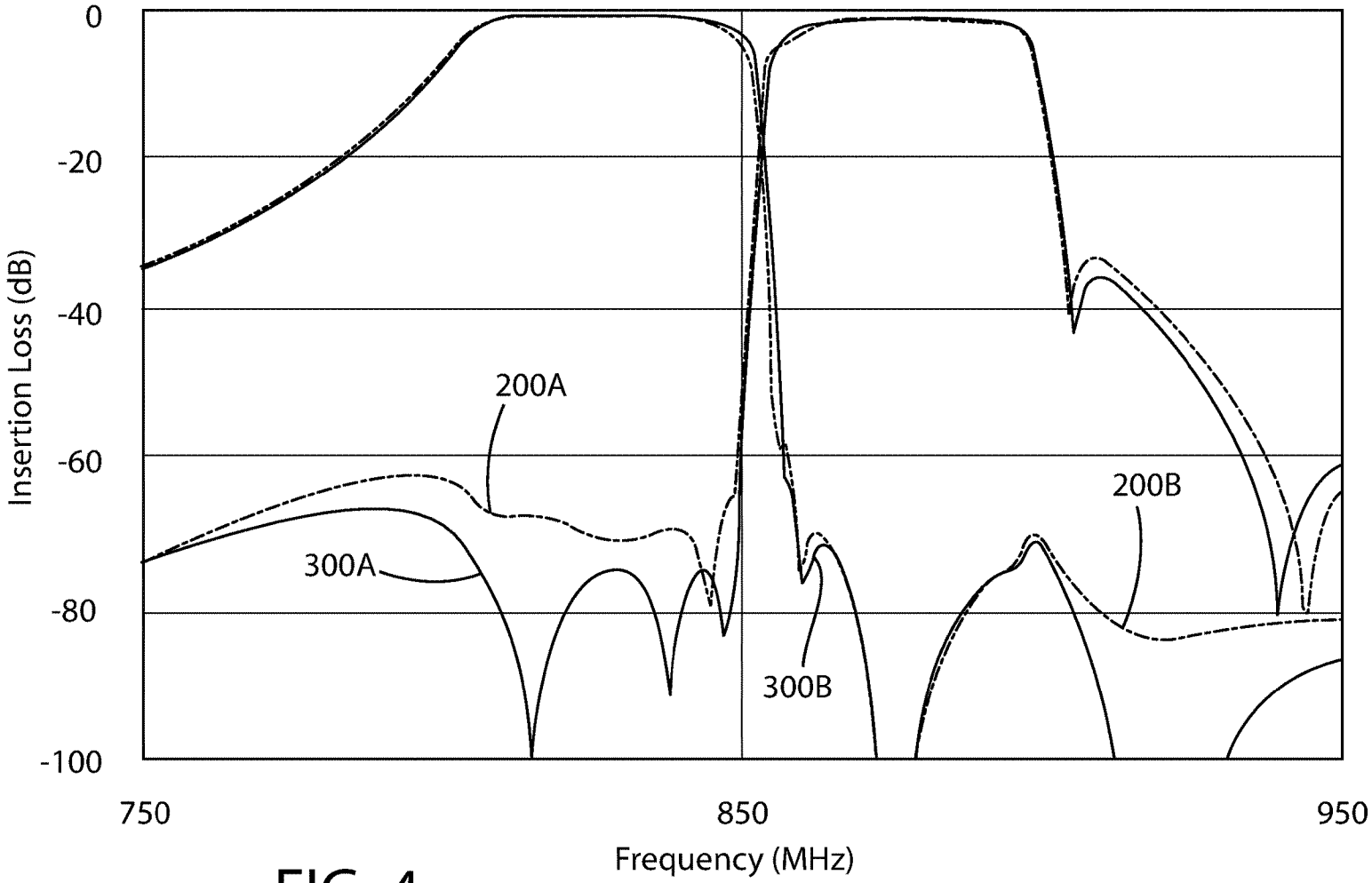
FIG. 4 is a graph depicting the performance of the ceramic monoblock RF filter as a function of Frequency (MHz) and Insertion Loss (dB) in accordance with the present invention.

FIG. 4 depicts the improved performance of the ceramic RF filter 100 in accordance with the present invention. More specifically, the dotted line generally designated with the numeral 200A in FIG. 4 depicts the high band performance of an RF filter without the grounded RF signal blocking through-holes of the present invention while the solid line generally designated with the numeral 300A in FIG. 4 depicts the improved high band performance and increased levels of rejection of the RF signal outside of the high band of the duplexer RF filter 100 incorporating the grounded RF signal blocking through-holes 160A-160G in accordance with the present invention.

Further, the dotted line generally designated with the numeral 200B in FIG. 4 depicts the low band performance of an RF filter without the grounded RF signal blocking through-holes of the present invention while the solid line generally designated with the numeral 300B in FIG. 4 depicts the improved low band performance and increased levels of rejection of the RF signal outside of the low band of the duplexer RF filter 100 incorporating the grounded RF signal blocking through-holes 160A-160G in accordance with the present invention Numerous variations and modifications of the ceramic monoblock RF filter of the present invention may be effected without departing from the spirit and scope of the novel features of the invention.

It is also to be understood that no limitations with respect to the embodiment illustrated herein are intended or should be inferred. It is, of course, intended to cover by the appended claims all such modifications as fall within the scope of the claims.

For example, it is understood that the present invention extends to a structure or means other than the grounded RF signal blocking through-hole passageways 160A-160G for blocking unwanted RF signal coupling including, for example slits or slots covered with metallization and extending between the top and bottom surfaces 132 and 133 of the filter 100.

I claim:

1. An RF filter for the transmission of an RF signal comprising:

a block of dielectric material including opposed top and bottom surfaces, opposed longitudinal side surfaces, and opposed transverse side surfaces;

at least first and second RF signal input/outputs defined on the block of dielectric material;

a first plurality of resonators defined on the block of dielectric material; and means on the block of dielectric material for blocking the coupling of the RF signal between the first and/or second RF signal input/outputs and respective ones of the first plurality of resonators or between respective non-adjacent ones of the first plurality of resonators;

the first plurality of resonators comprising a first plurality of through-hole resonators extending through the block of dielectric material and terminating in respective openings in the top and bottom surfaces of the block of dielectric material, the means for blocking the coupling of the RF signal comprising one or more grounded RF signal blocking through-holes extending through the block of dielectric material and terminating in respective openings in the top and bottom surfaces of the block of dielectric material and located in a relationship spaced and off-set from one or more of the first plurality of through-hole resonators; and the one or more RF signal blocking through-holes being located between and spaced from the first plurality of through-hole resonators and the respective opposed longitudinal side surfaces.

2. The RF filter of claim 1 comprising a plurality of the one or more RF signal blocking through-holes located on opposed sides of and spaced from the first plurality of through-hole resonators.

3. An RF filter for the transmission of an RF signal comprising:

a block of dielectric material including opposed top and bottom surfaces, opposed longitudinal side surfaces, and opposed transverse side surfaces;

a first plurality of through-holes extending through the block and terminating in respective openings in the top and bottom surfaces of the block and defining a first plurality of through-hole resonators; and a second plurality of through-holes extending through the block and terminating in respective openings in the top and bottom surfaces of the block, the second plurality of through-holes being located between the first plurality of through-holes and one or both of the respective opposed longitudinal side surfaces for blocking the coupling of the RF signal between selected ones of the first plurality of through-hole resonators.

4. The RF filter of claim 3, wherein the second plurality of through-holes are positioned on the block of dielectric material in a relationship spaced and off-set from the first plurality of through-holes.

5. The RF filter of claim 4, wherein the openings of the respective first and second plurality of through-holes defined in the top and bottom surfaces of the block of dielectric material are surrounded by pads of metallization and the interior surface of the respective first and second plurality of through-holes are covered with a layer of metallization to define the first plurality of through-hole resonators and the second plurality of through-holes defining a second plurality of grounded through-holes.

6. An RF filter for the transmission of an RF signal comprising:

a block of dielectric material including opposed top and bottom surfaces, opposed longitudinal side surfaces, and opposed transverse side surfaces;

first, second, and third RF signal input/outputs defined on the block of dielectric material;

a first plurality of through-holes extending through the block and terminating in respective openings in the top and bottom surfaces of the block and defining a first plurality of through-hole resonators; and a second plurality of grounded through-holes extending through the block and terminating in respective openings in the top and bottom surfaces of the block, the second plurality of grounded through-holes being located and positioned on opposite sides of and spaced from the first plurality of through-holes and further in a relationship off-set from the first plurality of through-holes for blocking the coupling of the RF signal between non-adjacent ones of the first plurality of through-hole resonators and between the first, second, and/or third RF signal input/outputs and selected ones of the first plurality of through-hole resonators.

7. The RF filter of claim 6 wherein a first one of the second plurality of grounded through-holes is positioned adjacent the first RF signal input/output and between first and second ones of the first plurality of through-hole resonators for blocking the coupling of the RF signal between the first RF signal input/output and the first one and a third one of first plurality of through-hole resonators.

8. The RF filter of claim 7 wherein a second one of the second plurality of grounded through-holes is positioned between the third one and a fourth one of the first plurality of through-hole resonators for blocking the coupling of the RF signal between the second one and the fourth one of the first plurality of through-hole resonators.

9. The RF filter of claim 8 wherein a third one of the second plurality of grounded through-holes is positioned adjacent to the second RF signal input/output and between a fifth and a sixth one of the first plurality of through-hole resonators for blocking the coupling of the RF signal between the fifth one of the first plurality of through-hole resonators and the second RF signal input/output.

10. The RF filter of claim 9 wherein a fourth one of the second plurality of grounded through-holes is positioned between the third and fourth ones of the first plurality of through-holes resonators for blocking the coupling of the RF signal between the third one and the fifth one of the first plurality of through-hole resonators.

11. The RF filter of claim 10 wherein a fifth one of the second plurality of grounded through-holes is positioned between the sixth one and a seventh one of the first plurality of through-hole resonators for blocking the coupling of the RF signal between the sixth one and the seventh one of the first plurality of through-hole resonators.

12. The RF filter of claim 11 wherein a sixth one of the second plurality of grounded through-holes is positioned adjacent the second RF signal input/output for blocking the coupling of the RF signal between the second RF signal input/output and the seventh one and an eighth one of the first plurality of through-hole resonators.

13. The RF filter of claim 11 wherein a seventh one of the second plurality of grounded through-holes is positioned adjacent the third RF signal input/output and between eleventh and twelfth ones of the first plurality of through-hole resonators for blocking the coupling of the RF signal between the third RF signal input/output and the eleventh one of the first plurality of through-hole resonators.

* * * * *